US006385320B1

(12) United States Patent
Lee

(10) Patent No.: US 6,385,320 B1
(45) Date of Patent: May 7, 2002

(54) SURROUND SIGNAL PROCESSING APPARATUS AND METHOD

(75) Inventor: Tae-Hyun Lee, Incheon (KR)

(73) Assignee: Daewoo Electronics Co., Ltd., Seoul (KR)

( * ) Notice: Subject to any disclaimer, the term of this patent is extended or adjusted under 35 U.S.C. 154(b) by 0 days.

(21) Appl. No.: 09/210,719

(22) Filed: Dec. 14, 1998

(30) Foreign Application Priority Data

Dec. 19, 1997 (KR) ..... 97-70356
Dec. 19, 1997 (KR) ..... 97-70366

(51) Int. Cl.[7] ..... H04R 5/00
(52) U.S. Cl. ..... 381/17; 381/1; 381/63
(58) Field of Search ..... 381/1, 63, 61, 381/17, 18, 62, 27, 28

(56) References Cited

U.S. PATENT DOCUMENTS 5,572,591 A 11/1996 Numazu et al. ..... 381/17

*Primary Examiner*—Minsun Oh Harvey

(74) *Attorney, Agent, or Firm*—Jacobson Holman, PLLC

(57) ABSTRACT

A surround signal processing apparatus and method can realize sound image localization and have reverberation effects. In the apparatus, left and right impulse measuring sections measure left and right impulses of a head related transfer function for an input audio signal based on a number of a plurality of lattices defined in a three dimensional space, horizontal and vertical angles defined by a center of a dummy head and the plurality of lattices. Left and right convolution operators convolve left and right channel signals of input audio signal with left and right impulses of head related transfer function, respectively, in order to localize sound image for input audio signal at an objective localization position. Left and right reverberators impart first and second reverberant sounds to left and right channel signals, respectively. According to the apparatus and method, it is possible to reproduce two pseudo surround signals from a pair of virtual rear speakers by use of a pair of actual front speakers; that is, to construct a 4-channel surround system by use of only two speakers. Further, they provides a listener with a feeling of presence as if he is listening to the music in a different sound field such as a spacious concert hall, church or stadium notwithstanding the fact that he is actually in an ordinary room, a listening room, or a vehicle.

4 Claims, 7 Drawing Sheets

SURROUND SIGNAL PROCESSING APPARATUS AND METHOD

BACKGROUND OF THE INVENTION

1. Field of the Invention

The present invention relates to a surround signal processing apparatus, and more particularly, to a surround signal processing apparatus and method which can realize sound image localization and have reverberation effects.

2. Prior Art

Conventionally, when stereophonic sound is reproduced in such a way as to provide a sound field expanding behind a listener or to localize a sound image behind a listener, two front speakers are arranged in front of a listener for stereophonic sound reproduction and at least one or two rear speaker are additionally arranged behind the listener for surround sound reproduction; in other words, at least three speakers must be arranged at the minimum around a listener. Further, in the case where surround sound is reproduced on the basis of a one-system surround signal or a center channel is additionally required to be reproduced as with the case of the 3-1 system of high vision high definition TV(HDTV), one or two additional center speakers must be arranged. Therefore, amplifiers and cables corresponding to the numbers of the reproduced channels are necessary.

U.S. Pat. No. 5,572,591, (issued to Hiroko Numazu et al. on Nov. 5, 1996) discloses a sound field controller for reproducing sound effects for use in audio equipment or in audio-visual(AV) equipment.

FIGS. 1 and 2 are views for showing conventional surround signal processors. As shown in FIG. 1 for instance, in the case of the surround sound reproduction, it has been necessary to arrange two front L(left)- and R(right)-channel speaker sets for stereophonic sound on front left and right sides of a listener LM, two rear SL(surround left)- and SR(surround right)-channel speaker sets for surround sound on rear left and right sides thereof, and further a C(center)-channel speaker at the front middle thereof, respectively.

However, since it is difficult to arrange the two rear speakers and the center speaker from the standpoint of space and cost, in homes or vehicles, as shown in FIG. 2, only L- and R-channel speakers are installed on the front left and right sides of a listener LM in practice. In this speaker arrangement, it has become impossible to obtain sufficient surround sound effect. In the case of the surround reproduction system using a monophonic surround signal in particular, although this system has such a feature that a sound field can be obtained on the rear side of a listener or the sound image can be shifted, it has been impossible to obtain such effects as described above without arranging the rear speakers.

SUMMARY OF THE INVENTION

Therefore, it is an object of the present invention, for the purpose of solving the above mentioned problems, to provide a surround signal processing apparatus and method which can realize sound image localization and have reverberation effects.

In order to attain the object, according to the present invention, there is provided a surround signal processing apparatus, said apparatus comprising:

left and right impulse measuring sections for measuring left and right impulses of a head related transfer function for an input audio signal based on a number of a plurality of lattices defined in a three dimensional space, horizontal and vertical angles defined by a center of a dummy head and the plurality of lattices;

left and right convolution operators for convolving left and right channel signals of the input audio signal with the left and right impulses of the head related transfer function from the left and right impulse measuring sections, respectively, in order to localize sound image for the input audio signal at an objective localization position in the three-dimension space; and left and right reverberators for imparting first and second reverberant sounds to the left and right channel signals of the input audio signal from the left and right convolution operators, respectively.

Also, the present invention provides a surround signal processing method, said method comprising the steps of:

(a) measuring left and right impulses of a head related transfer function for an input audio signal based on a number of a plurality of lattices defined in a three dimensional space, horizontal and vertical angles defined by a center of the three dimensional space and the plurality of lattices;

(b) convolving left and right side signals of the input audio signal with the left and right impulses of the head related transfer function measured in step (a), respectively, in order to localize sound image for the input audio signal at an objective localization position in the three dimensional space; and (c) imparting first and second reverberant sounds to the left and right side signals of the input audio signal, respectively.

According to the present invention, it is possible to localize the sound images of the surround signals at two different rear positions apart from the two front positions at which a pair of speakers are arranged, on the basis of the sound signals reproduced through speakers. The present invention also provides a listener with a feeling of presence as if he is listening to the music in a different sound field such as a spacious concert hall, church or stadium notwithstanding the fact that he is actually in an ordinary room, a listening room, or a vehicle.

Other objects and further features of the present invention will become apparent from the detailed description when read in conjunction with the attached drawings.

BRIEF DESCRIPTION OF THE DRAWINGS

Other features and advantages of the present invention will become more apparent from the following description taken in connection with the accompanying drawings, wherein.

DETAILED DESCRIPTION OF THE PREFERRED EMBODIMENT

Figure 1:
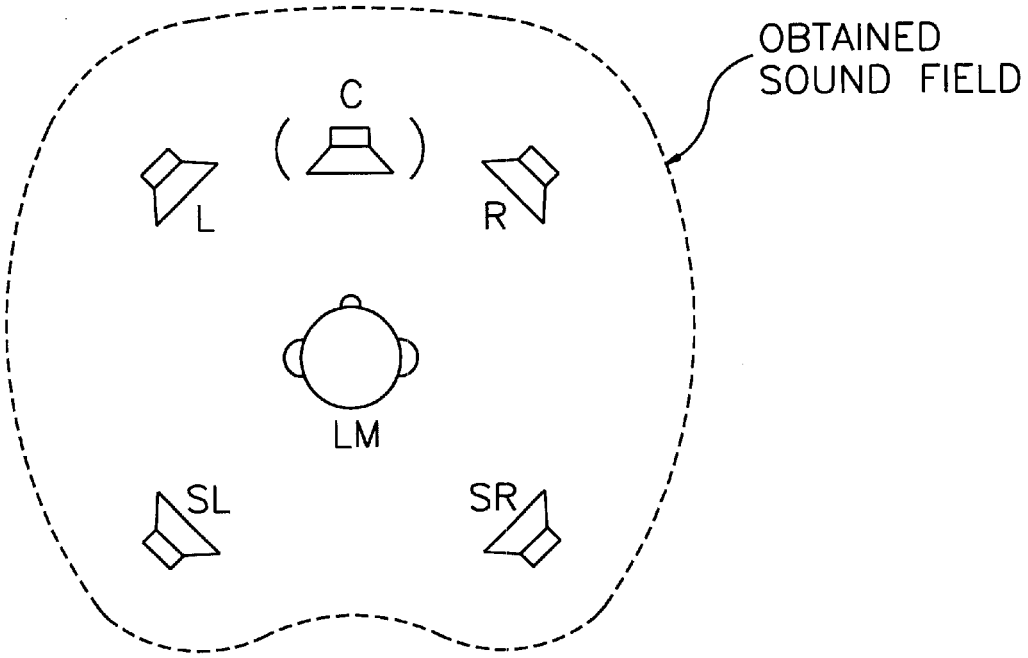
FIG. 1 PRIOR ART
FIGS. 1 and 2 are views for showing conventional surround signal processors.
Figure 2:
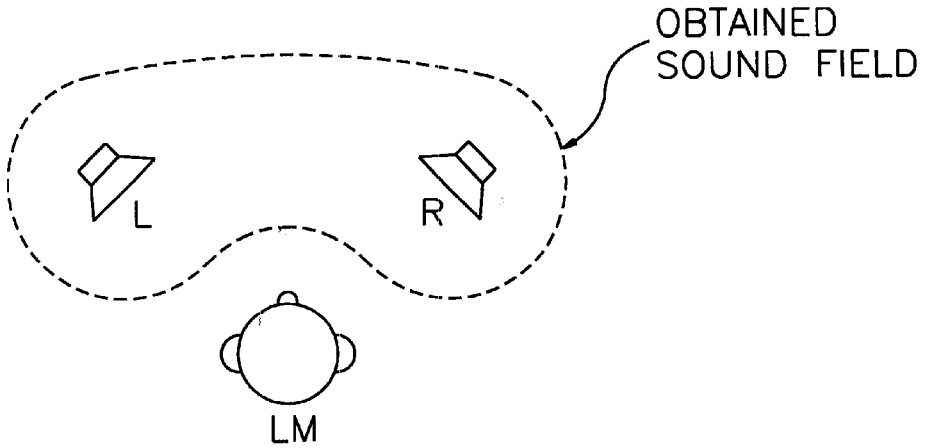
FIG. 2 PRIOR ART
Figure 3:
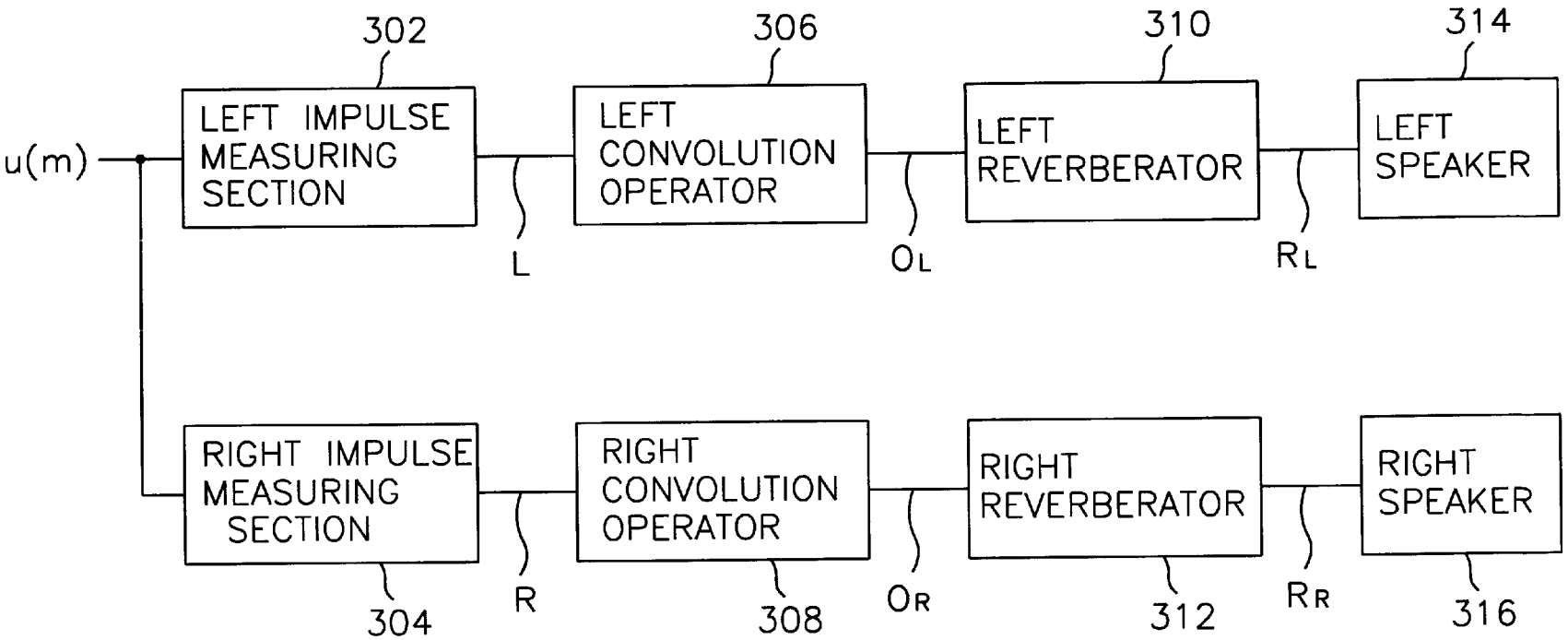
FIG. 3 is a block diagram for showing a configuration of a surround signal processing apparatus according to an embodiment of the present invention.

The preferred embodiment of the present invention will hereinafter be described in detail with reference to the accompanying drawings. FIG. 3 shows a configuration of a surround signal processing apparatus 30 according to an embodiment of the present invention. The surround signal processing apparatus 30 includes left and right impulse measuring sections 302 and 304, left and right convolution operators 306 and 308, and left and right reverberators 310 and 312.

Figure 4:
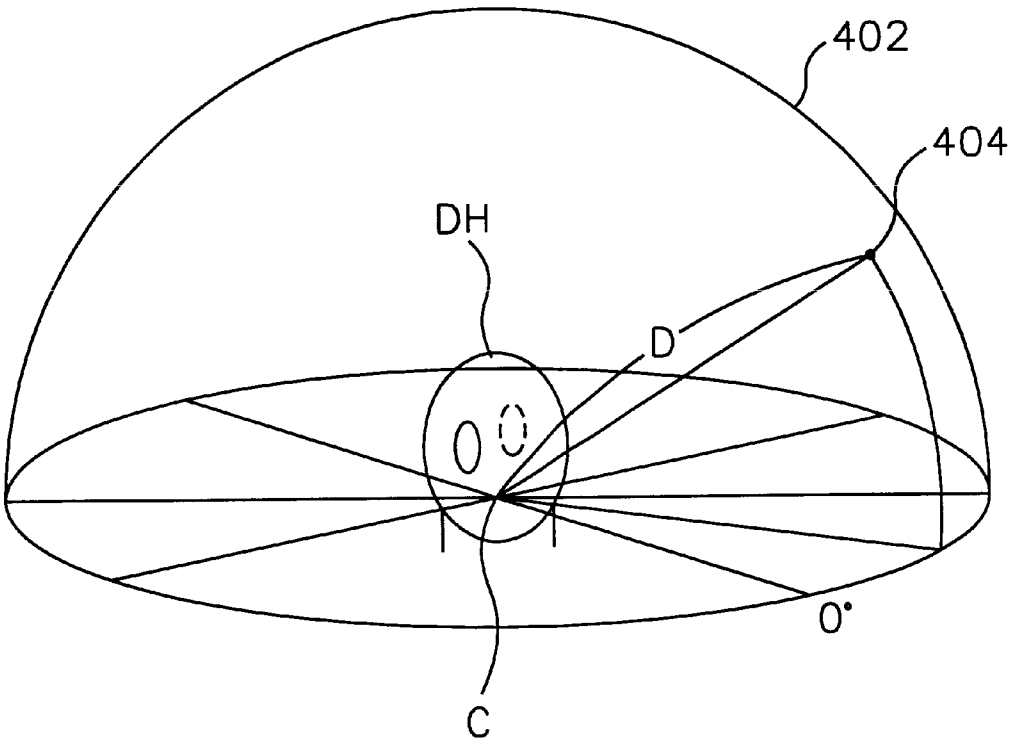
FIG. 4 is a view showing a principle of measuring left and right impulses of a head related transfer function in a three dimensional space by the right and left impulse measuring sections shown in FIG. 3.

FIG. 4 shows a method of measuring left and right impulses of a head related transfer function in a three dimensional space by the right and left impulse measuring sections shown in FIG. 3. The left and right impulse measuring sections 302 and 304 measure left and right impulses $h_L(\theta_i, \phi_j, n)$ and $h_R(\theta_i, \phi_j, n)$ of a head related transfer function (HRTF) for an input audio signal u(m) based on a number n of a plurality of lattices defined in the three dimensional space 402, horizontal and vertical angles $\theta_i$ and $\phi_j$ defined by a center C of a dummy head DH and a center of the plurality of lattices 404. The $\theta_i$ represents a horizontal angle defined by the center C of the dummy head DH and the centers P of each of the plurality of lattices, $\phi_j$ represents a vertical angle defined by the center C of the dummy head DH and the centers P of the plurality of lattices 404 (only one is shown in FIG. 4), and n represents a total number of lattices. The dummy head DH is located at a center of the three dimensional space 402. The three dimensional space 402 is divided into a plurality of horizontal planes by a horizontal angle $\theta_i$(where, i=1,2,3,4, . . . , N) and a plurality of vertical planes by a vertical angle $\phi_j$(j=1,2,3,4. . . M) to define N×M(where, N and M are integers greater than 4) lattices.

The left and right convolution operators 306 and 308 convolve left and right side channel signals L and R of the input audio signal u(m) with the left and right impulses $h_L(\theta_i, \phi_j, m)$ and $h_R(\theta_i, \phi_j, m)$ of the head related transfer function from the left and right impulse measuring sections 302 and 304, respectively, in order to localize a sound image for the input audio signal u(m) at an objective localization position in the three dimensional space 402. The outputs $O_L(\theta_i, \phi_j, m)$ and $O_R(\theta_i, \phi_j, m)$ of left and right convolution operators 306 and 308 are defined as follows:

$$O_L(\theta_i, \phi_j, m) = \sum_{n=0}^{L-1} h_L(\theta_i, \phi_j, n)u(m-n)$$

and $$O_R(\theta_i, \phi_j, m) = \sum_{n=0}^{L-1} h_R(\theta_i, \phi_j, n)u(m-n)$$

The left and right reverberators 310 and 312 impart first and second reverberant sounds to the left and right channel signals L and R of the input audio signal u(m) from the left and right convolutions operators 306 and 308, respectively. The outputs $R_L$ and $R_L$ of the left and right reverberators 310 and 312 are $$O_L(\theta_i, \phi_j, m) + g1 + g2 \cdot z^{-}3 + \frac{g + z^{-}1}{1 + g \cdot z^{-}1}$$

and $$O_R(\theta_i, \phi_j, m) + g1 + g2 \cdot z^{-}3 + \frac{g + z^{-}1}{1 + g \cdot z^{-}1},$$

respectively.

Figure 5:
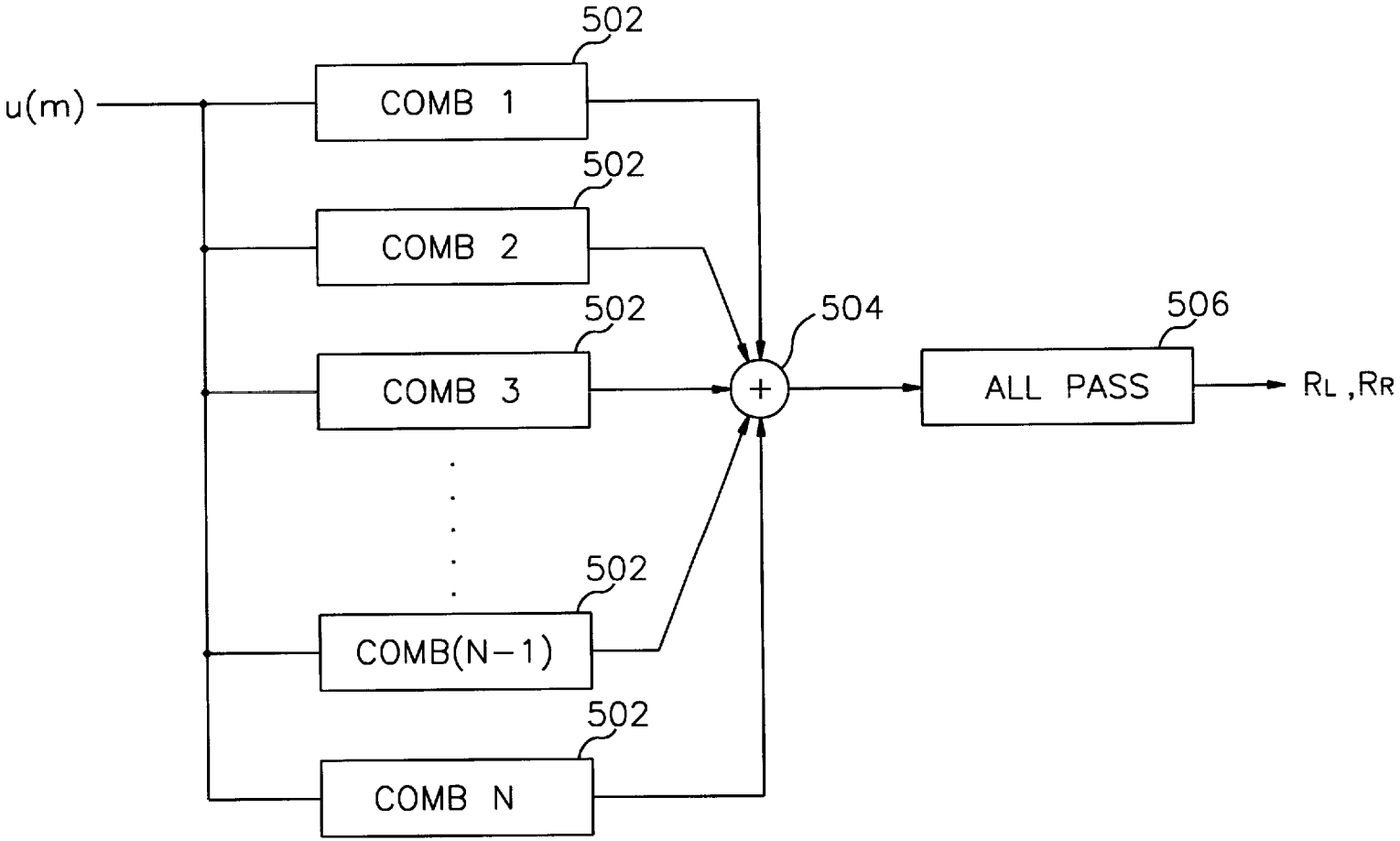
FIG. 5 is a block diagram for showing one example of the reverberator shown in FIG. 3.

FIG. 5 shows one example of the reverberator shown in FIG. 3. The left and right reverberators 310 and 312 each includes a plurality of comb filters 502 for comb-filtering the input audio signal u(m) to obtain early reflected sounds, an adder 504 for adding the output signals of the plurality of comb filters 502 together, and an all pass filter 506 for filtering the output signal of the adder to obtain a late reflected sound.

Figure 6A:
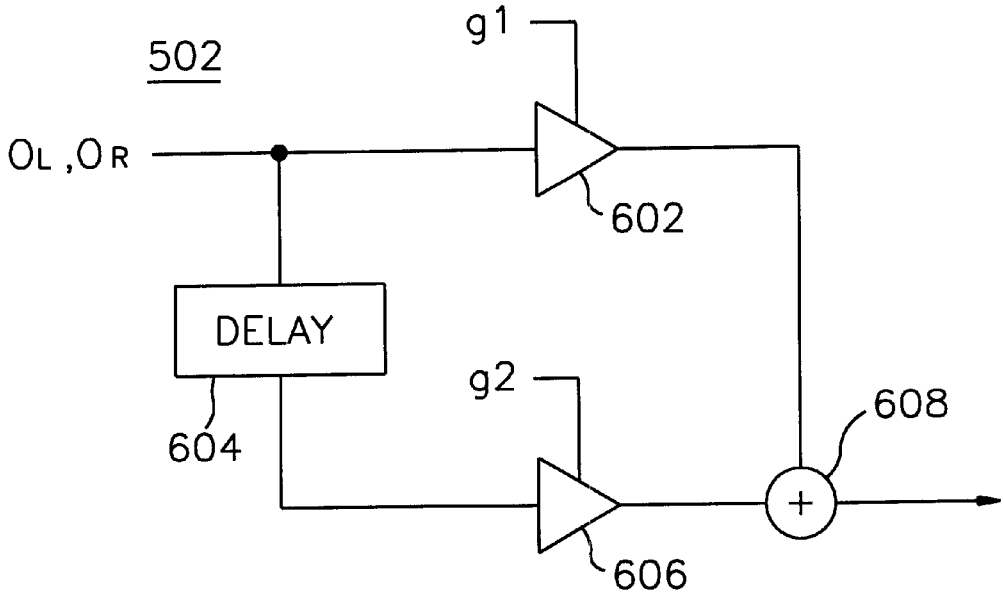
FIG. 6A is a block diagram for showing one example of the comb filter shown in FIG. 5.
Figure 6B:
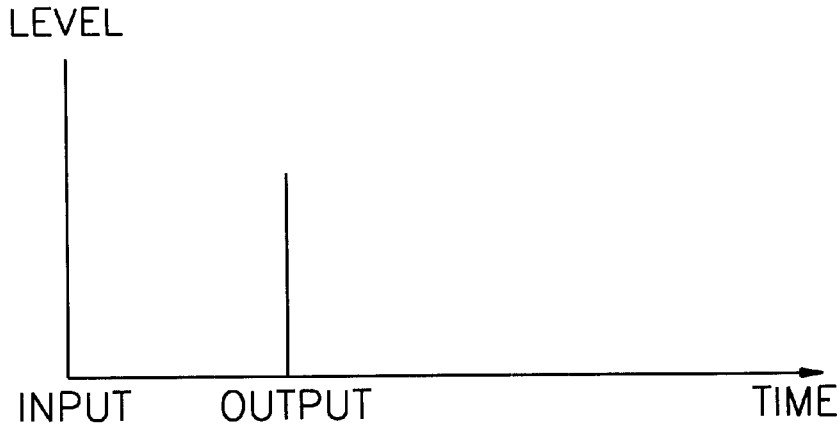
FIG. 6B is a graph for showing the impulse response characteristic of the comb filter shown in FIG. 5A.

FIG. 6A shows one example of one comb filter 502 shown in FIG. 5 and FIG. 6B shows the impulse response characteristic of the comb filter 502 shown in FIG. 5A. The plurality of comb filters 502 each includes a first gain amplifier 602, a delay circuit 604, a second gain amplifier 606, and, an adder 608. The plurality of comb filters 502 each has a transfer function $H(z)=g1+g2 \cdot z^{-}3$. Each of the plural comb filters 502 may be of the same function as one another.

The first gain amplifier 602 receives and firstly amplifies the output signal from one of the left and right convolution operators 310 and 312 by a first predetermined gain g1. The delay circuit 604 delays the output signal of one of the left and right convolution operators 310 and 312 received by the first gain amplifier 602 by a predetermined time. The second gain amplifier 606 secondly amplifies the delayed signal from the delay circuit 604 by a second predetermined gain g2. The adder 608 adds the second amplified signal from the second gain amplifier 606 to the first amplified signal from the first gain amplifier 602 in order to obtain the early reflected sound $g1+g2 \cdot z^{-}3$ as shown in FIG. 6B.

Figure 7A:
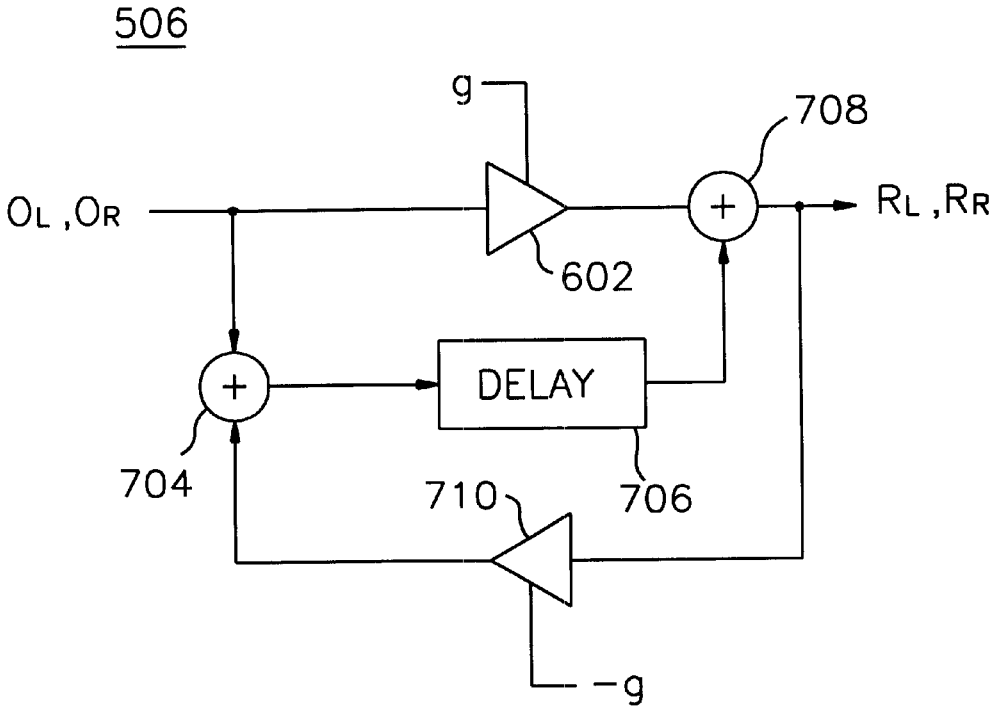
FIG. 7A is a block diagram for showing one example of an all pass filter shown in FIG. 5.
Figure 7B:
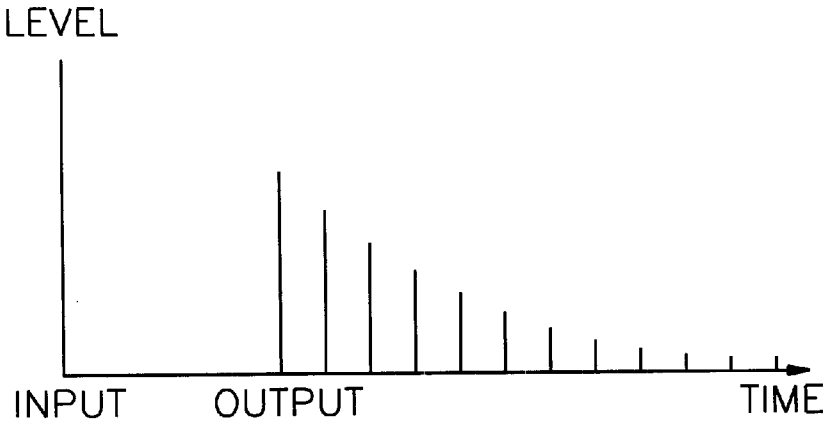
FIG. 7B is a graph for showing the impulse response characteristic of the all pass filter shown in FIG. 7A.

FIG. 7A shows one example of the all pass filter 506 shown in FIG. 5 and FIG. 7B shows the impulse response characteristic of the all pass filter 506 shown in FIG. 7A.

The all pass filter 506 includes a first gain amplifier 702, a first adder 704, a delay circuit 706, a second adder 708, and a second gain amplifier 710. The all pass filter 506 has a transfer function $$H(z) = \frac{g + z^{-}1}{1 + g \cdot z^{-}1}.$$

The first gain amplifier 702 receives and amplifies the output signal of the adder 504 by a first predetermined gain g. The first adder 704 adds a feedback signal to the output signal of the adder received by the first gain amplifier 702. The delay circuit 706 delays the first added signal from the first adder by a predetermined time. The second adder 708 adds the delayed signal from the delay circuit 706 to the amplified signal from the first gain amplifier 702 to generate the late reflected sound $$\frac{g + z^{-}1}{1 + g \cdot z^{-}1}$$

as shown in FIG. 7B. The second gain amplifier 710 amplifies the second added signal from the second adder 708 by a second predetermined gain −g to generate the feedback signal.

Figure 8:
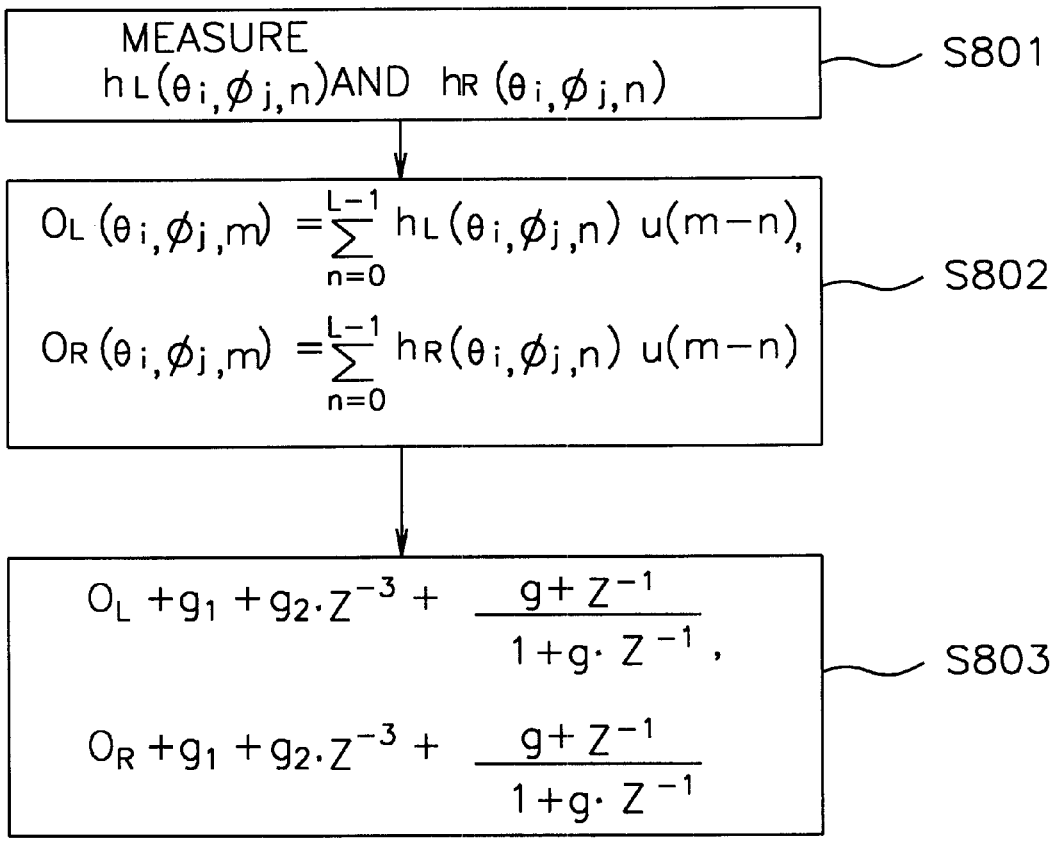
FIG. 8 is a view for illustrating a surround signal processing method according to an embodiment of the present invention.

Hereinafter, an operation of the surround signal processing apparatus and the surround signal processing method according an embodiment of the present invention with reference to FIG. 8 is presented. FIG. 8 illustrates a surround signal processing method according to an embodiment of the present invention.

In step S801, the left and right impulse measuring sections 302 and 304 measure left and right impulses $h_L(\theta_i, \phi_j, n)$ and $h_R(\theta_i, \phi_j, n)$ of a head related transfer function for an input audio signal u(m) based on a number n of a plurality of lattices defined in the three dimensional space 402, horizontal and vertical angles $\theta_i$ and $\phi_j$ defined by a center C of the three dimension space 402 and the plurality of lattices 404. The left and right impulses $h_L(\theta_i, \phi_j, n)$ and $h_R(\theta_i, \phi_j, n)$ of a head related transfer function for the input audio signal from the left and right impulse measuring sections 302 and 304 are provided to left and right convolution operators 306 and 308, respectively.

In step S802, the left and right convolution operators 306 and 308 convolve left and right side signals L and R of the input audio signal with the left and right impulses $h_L(\theta_i, \phi_j, n)$ and $h_R(\theta_i, \phi_j, n)$ of the head related transfer function from the left and right impulse measuring sections 302 and 304, respectively, in order to localize a sound image for the input audio signal at an objective localization position in the three dimensional space 402. The outputs $O_L(\theta_i, \phi_j, m)$ and $O_R(\theta_i, \phi_j, m)$ of left and right convolution operators 306 and 308 are defined as follows:

$$O_L(\theta_i, \phi_j, m) = \sum_{n=0}^{L-1} h_L(\theta_i, \phi_j, n)u(m-n)$$

and $$O_R(\theta_i, \phi_j, m) = \sum_{n=0}^{L-1} h_R(\theta_i, \phi_j, n)u(m-n).$$

The outputs $O_L(\theta_i, \phi_j, m)$ and $O_R(\theta_i, \phi_j, m)$ of left and right convolution operators 306 and 308 are supplied to the left and right reverberators 310 and 312, respectively.

In step S803, the left and right reverberators 310 and 312 impart firs and second reverberant sound $$g1 + g2 \cdot z^{-}3 + \frac{g + z^{-}1}{1 + g \cdot z^{-}1}$$

to the left and right side signals L and R of the input audio signal u(m) from the left and right convolution operators 306 and 308, respectively. The outputs $R_L$ and $R_L$ of the left and right reverberators 310 and 312 are $$O_L(\theta_i, \phi_j, m) + g1 + g2 \cdot z^{-}3 + \frac{g + z^{-}1}{1 + g \cdot z^{-}1}$$

and $$O_R(\theta_i, \phi_j, m) + g1 + g2 \cdot z^{-}3 + \frac{g + z^{-}1}{1 + g \cdot z^{-}1},$$

respectively.

As described above, in the surround signal processing apparatus according to the present invention, it is possible to localize the sound images of the surround signals at two different rear positions apart from the two front positions at which a pair of speakers are arranged, on the basis of the sound signals reproduced through speakers. Therefore, it is possible to reproduce two pseudo surround signals from a pair of virtual rear speakers by use of a pair of actual front speakers; that is, to construct a 4-channel surround system by use of only two speakers. Further, since being small in hardware scale and thereby low in cost, the surround signal processing method and apparatus according to the present invention can be used with low-priced home appliances such as a television or a car audio system. Also, the present invention provides a listener with a feeling of presence as if he was listening to the music in a different sound field such as a spacious concert hall, church or stadium notwithstanding the fact that he is actually in an ordinary room, a listening room, or a vehicle.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A surround signal processing apparatus, said apparatus comprising:

left and right impulse measuring sections for measuring left and right impulses of a head related transfer function for an input audio signal based on a number of a plurality of lattices defined in a three dimensional space, horizontal and vertical angles defined by a center of a dummy head and the plurality of lattices;

left and right convolution operators for convolving left and right channel signals of the input audio signal with the left and right impulses of the head related transfer function from the left and right impulse measuring sections, respectively, in order to localize sound image for the input audio signal at an objective localization position in the three-dimension space; and left and right reverberators for imparting first and second reverberant sounds to the left and right channel signals of the input audio signal from the left and right convolution operators, respectively.

2. The apparatus as defined in claim 1, wherein the left and right reverberators each includes a plurality of comb filters for comb-filtering the input audio signal to obtain early reflected sounds, an adder for adding the output signals of the plurality of comb filters together, and an all pass filter for filtering the output signal of the adder to obtain a late reflected sound.

3. The apparatus as defined in claim 2, wherein the plurality of comb filters each includes a first gain amplifier for receiving and firstly amplifying the output signal from one of the left and right convolution operators by a first predetermined gain;

a delay circuit for delaying the output signal of one of the left and right convolution operators received by the first gain amplifier by a predetermined time;

a second gain amplifier for secondly amplifying the delayed signal from the delay circuit by a second predetermined gain; and an adder for adding the second amplified signal from the second gain amplifier to the first amplified signal from the first gain amplifier in order to obtain the early reflected sound.

4. The apparatus as defined in claim 2, wherein the all pass filter includes a first gain amplifier for receiving and firstly amplifying the output signal of the adder by a first predetermined gain;

a first adder for firstly adding a feedback signal to the output signal of the adder received by the first gain amplifier;

a delay circuit for delaying the first added signal from the first adder by a predetermined time;

a second adder for secondly adding the delayed signal from the delay circuit to the first amplified signal from the first gain amplifier to generate the late reflected sound; and a second gain amplifier for secondly amplifying the second added signal from the second adder by a second predetermined gain to generate the feedback signal.

* * * * *